US007114301B2

(12) United States Patent
Bibaud et al.

(10) Patent No.: US 7,114,301 B2
(45) Date of Patent: Oct. 3, 2006

(54) FLASHING FOR INCLINED ROOF AND METHOD FOR INSTALLING THE SAME

(75) Inventors: André Bibaud, St Hippolyte (CA); Simon Groulx, ST- Jérôme (CA)

(73) Assignee: Compagnie de Cheminees Industrielles, Inc., Quebec (CA)

( * ) Notice: Subject to any disclaimer, the term of this patent is extended or adjusted under 35 U.S.C. 154(b) by 376 days.

(21) Appl. No.: 10/793,937

(22) Filed: Mar. 8, 2004

(65) Prior Publication Data

US 2004/0255523 A1 Dec. 23, 2004

(51) Int. Cl.

| | |
|---|---|
| ***E04D 13/14*** | (2006.01) |
| ***E04D 1/36*** | (2006.01) |
| ***F16K 15/03*** | (2006.01) |
| ***F16K 55/07*** | (2006.01) |
| ***E04B 7/00*** | (2006.01) |

(52) U.S. Cl. ..... 52/219; 52/58; 52/62; 52/220.8; 52/741.1; 285/42; 285/43

(58) Field of Classification Search ..... 52/58, 52/219, 218, 302.6, 726.5, 86, 62, 220.8, 52/741.1, 200; 285/42, 43, 44, 424, 133.6, 285/148.24, 183

See application file for complete search history.

(56) References Cited

U.S. PATENT DOCUMENTS

| | | | | |
|---|---|---|---|---|
| 1,615,929 | A * | 2/1927 | Buckles et al. | 285/43 |
| 1,875,640 | A * | 9/1932 | Moore | 285/44 |
| 2,347,836 | A * | 5/1944 | Moore | 285/289.1 |

(Continued)

OTHER PUBLICATIONS

Selkirk Canada Corp., Superpro home page, Nov. 16, 2004.

Selkirk Canada Corp., Superpro 2100 Chimney (ALT), pp. 1-2, product list 2004.

Selkirk Canada Corp., Superpro Chimney (SPR), pp. 1-3, product list 2004.

(Continued)

*Primary Examiner*—Robert Canfield
*Assistant Examiner*—Abdul Manaf
(74) *Attorney, Agent, or Firm*—Jacobson Holman PLLC

(57) ABSTRACT

Disclosed is a flashing for weatherproofing an aperture made in an inclined roof to allow passage of a vertical member such as chimney through the inclined roof. This flashing has a base member adapted to be mounted over the aperture and a surrounding member that is tubular in shape and extends upwardly from the base member to fit around the vertical member. The base member comprises a covering panel of quadrilateral shape having a top edge adapted to be positioned on an upper part of the inclined roof, a bottom edge adapted to be positioned on a lower part of the inclined roof, two opposite side edges and an opening large enough to allow passage of the vertical member therethrough. A bottom side wall projects downwardly from the bottom edge of the covering panel and two lateral side walls respectively extend downwardly from the opposite side edges of the covering panel and sidewardly from the bottom side wall in a tapering fashion. The covering panel, bottom side wall and lateral side walls together defines a hollow housing. This flashing can be installed by (1) cutting a slot in the upper part of the inclined roof above the aperture made therein, so as to receive the top edge of the covering panel of the base member, (2) inserting the top edge of the covering panel into the slot cut in the inclined roof (3) positioning the bottom side wall of the base member onto the lower part of the inclined roof in such a manner that the bottom opening of the surrounding member is located on top of the roof aperture; and (4) fastening the base member to the inclined roof. Thanks to its particular structure and the way it is installed, the flashing according to the invention may be installed in a very easy and efficient manner on any kind of roofs, including inclined roofs with a corrugated structure defining downwardly oriented ridges.

16 Claims, 11 Drawing Sheets

U.S. PATENT DOCUMENTS

| | | | | |
|---|---|---|---|---|
| 3,098,663 | A * | 7/1963 | Dibley | 285/43 |
| 4,563,847 | A * | 1/1986 | Hasty | 52/219 |
| 4,809,468 | A * | 3/1989 | Bareiss | 52/22 |
| 5,472,241 | A * | 12/1995 | Kosik et al. | 283/42 |
| 5,596,848 | A * | 1/1997 | Lynch | 52/200 |
| 5,647,178 | A * | 7/1997 | Cline | 52/219 |
| 6,296,560 | B1 * | 10/2001 | Quick | 454/44 |
| 6,830,065 | B1 * | 12/2004 | Sinur et al. | 137/527.8 |
| 2004/0130154 | A1 * | 7/2004 | Stepp et al. | 285/424 |
| 2005/0204648 | A1 * | 9/2005 | Bibaud et al. | 52/58 |

OTHER PUBLICATIONS

Selkirk Canada Corp., All 304 Stainless steel SUPERPRO 2100 Factory Built Chimney (SuperVent Products Inc.), pp. 1-8, Catalog.
Selkirk Canada Corp., SuperVent 2100 & Superpro 2100 factory-built 650° C. Insulated Chimney—Installation Instructions and Maintenance Guide, pp. 1-17, Jun. 2004.
Selkirk Canada Corp., Selkirk Superpro, pp. 1-7, Catalog.
Selkirk Canada Corp., All 304 Stainless steel Factory Built Chimney, Jul. 2002.
Selkirk Canada Corp., SuperVent home page, Nov. 16, 2004.
Selkirk Canada Corp., Canadian installation instructions, warranty and maintenance guide—Model FC Factory Built Insulated Chimney, SuperVent Products Inc., pp. 1-9, Nov. 22, 2000.
Selkirk Canada Corp., All 304 Stainless steel Superpro factory built chimney—SuperVent Products Inc., pp. 1-9, Catalog.
Selkirk Canada Corp., U.S. Installation instructions, waranty and maintenance guide, pp. 1-16, Sep. 2004.
Selkirk Canada Corp., SuperVent 2100 and Superpro 2100 factory built 650° C. Insulated Chimney—Installation Instructions and maintenance guide, pp. 1-17, Jun. 2004.
Selkirk Canada Corp., SuperVent Model JSC insulated stainless steel chimney, pp. 1-8.
Selkirk Canada Corp., Selkirk chimney, venting and fireplaces home page, Nov. 16, 2004.
Selkirk Canada Corp., Selkirk CF Sentinel—installation instructions, pp. 1-3, Nov. 18, 2004.
Selkirk Canada Corp., Selkirk Model CF Ceiling Supported Chimney installation instructions, pp. 1-7, Jan. 2001.
Selkirk Canada Corp., Selkirk Model CF Wall Supported Chimney installation instructions, pp. 1-7.
Selkirk Canada Corp., Selkirk Model SS Chimney with adjustable roof support and model CF roof supported chimney, pp. 1-7.
Selkirk Canada Corp., Selkirk Universal roof brace kit assembly, (Brochure), Jun. 2000.
Selkirk Canada Corp., Selkirk Model CF Chimney with a cathedral ceiling support box, pp. 1-7, (Brochure), Sep. 2000.
Selkirk Canada Corp., Selkirk Metalbestos—Installation and instructions for model CF anchor plate.
Selkirk Canada Corp., Sentinel CF installation instructions new attic insulation shield, Oct. 2003.
Selkirk Canada Corp., Model Ultra-temp factory-built insulated chimney—installation, instructions and maintenance guide (Canada only), pp. 1-17.
Selkirk Canada Corp., Ultra-temp stainless steel insulated chimney, pp. 1-11.
Selkirk Canada Corp., Typical installations ceiling support installations, (Brochure).
Selkirk Canada Corp., Installation instructions (Canada only) Model UT/ST insulated chimney, ultra-temp sure-temp, pp. 1-11.
Selkirk Canada Corp., Venting home page, Nov. 16, 2004.
Selkirk Canada Corp., DSP Literature, Nov. 18, 2004.
Selkirk Canada Corp., Model DSP DoubleWall Stove Pipe, (Catalog), pp. 1-10.
Selkirk Canada Corp., Model IWT Chimney Connector Wall Thimble (Brochure).
Selkirk Canada Corp., Model DSP—Factory build chimney connection, pp. 1-7.
Selkirk Canada Corp., Selkirk Metalbestos Model SL Rigid Liner—installation instructions, pp. 1-19, Jun. 1998.
Selkirk Canada Corp., Flexible chimney liner product catalog, pp. 1-8.
Selkirk Canada Corp., Stainless steel flexible chimney liner—installation instructions, pp. 1-11, Feb. 2004.
Selkirk Canada Corp., Installation instructions for Selkirk Metalbestos type B gas vent model RV, pp. 1-4, Feb. 1990.
Selkirk Canada Corp., Gas Vent Catalogue—Canada—Model RV—Small Diameter Round Vent—Model QC—Large Diameter Round Vent—Model DWC—Flexible Double Wall Connector, pp. 1-11, Apr. 2002.
Selkirk Canada Corp., Selkirk type B gas vent features (Brochure).
Selkirk Canada Corp., Selkirk—Flexible double wall gas vent connector—Model DWC (Brochure).
Selkirk Canada Corp., Installation instructions for Selkirk Metalbestos Type L Vent model DWS, pp. 1-5.
Selkirk Canada Corp., Model VP L-Vent/Vent system for pellet burning appliances (Brochure), pp. 1-10.
Selkirk Canada Corp., Selkirk—Direct-temp metalbestos direct vent system and catalog, pp. 1-15.
Selkirk Canada Corp., Chimney Residential home page.
Selkirk Canada Corp., Vent for pellet stoves—HVAC (Brochure).
Selkirk Canada Corp., Secure-temp ASHT+ factory-built chimney—type HT installation and operating instructions, pp. 1-3, Feb. 2003.
Selkirk Canada Corp., Security Chimneys—Venting instructions secure vent direct vent system for direct gas fireplaces and stoves, pp. 1-14, Apr. 2001.
Selkirk Canada Corp., Security Chimneys—Factory-built venting system SP model—Type L-Vent—installation and operating instructions, pp. 1-9, Sep. 1998.
Selkirk Canada Corp., SL-Vent Type L, Vent—installation and operating instructions, pp. 1-9, Mar. 1999.
Selkirk Canada Corp., Chimneys Industrial and Commercial (Brochure).
Selkirk Canada Corp., CI positive pressure chimney system (Brochure).
Selkirk Canada Corp., Gas vent type B—installation and operating instructions, May 1999.
Selkirk Canada Corp., DuraVent DuraTech Chimney: United States and Canada, Nov. 18, 2004.
Selkirk Canada Corp., DuraVent DuraPlus Chimney: United States and Canada, Nov. 11, 2004.
Selkirk Canada Corp., DuraVent Direct Vent GS: United States and Canada, Nov. 18, 2004.
Selkirk Canada Corp., DuraVent Type B Gas Vent: United States and Canada, Nov. 11, 2004.
Selkirk Canada Corp., DuraVent Pellet Vent: United States and Canada, Nov. 18, 2004.

Selkirk Canada Corp., American Metal Products home page.
Selkirk Canada Corp., Installation and Maintenance Instructions—Ameri-Tec Model HS Factory Built Chimney, pp. 1-9.
Selkirk Canada Corp., Installation and Maintenance Instructions—Ameri-Vent Model 10 FB Factory-Built Chimney, pp. 1-8.
Selkirk Canada Corp., Pipe Boot Express home page.
Selkirk Canada Corp., Pipe Boot Express Technical Data—Square Base Pipe Flashing.
Selkirk Canada Corp., Pipe Boot Express Technical Data—Flasher Pipe Flashing.
Selkirk Canada Corp., Pipe Boot Express Technical Data—Square Base, RetroFit Pipe Flashing.
Selkirk Canada Corp., Pipe Boot Express Technical Data—Round Base, Retrofit Pipe Flashing.
Selkirk Canada Corp., Plumbing Flashings Index Plumbing Flashings (Index Table), Nov. 11, 2004.
Selkirk Canada Corp., Heating Flashings Flat B Vent Chimney Roof Flashings (26 gauge) (Index Table), Nov. 23, 2004.
Selkirk Canada Corp., Heating Flashings Pitched B Vent Chimney Roof Flashings (26 gauge) (Index Table), Nov. 23, 2004.
Selkirk Canada Corp., Model VP Pellet Stove Pipe Product List 2004.
Selkirk Canada Corp., Model CF Sentinel 2100 Chimney Product List 2004.
Selkirk Canada Corp., Model QC Type "B" Gas Vent Product List 2004.
Selkirk Canada Corp., Model RV Type "B" Gas Vent Product List 2004.
Selkirk Canada Corp., SuperVent 2100 Chimney (JM) Product List 2004.
Selkirk Canada Corp., SuperVent Chimney (JSC) Product List 2004.
Selkirk Canada Corp., Ultra Temp (10") Insulated Chimney Product List 2004.
Selkirk Canada Corp., Ultra Temp (12"-14") Insulated Chimney Product List 2004.
Selkirk Canada Corp., Ultra Temp (5'-8") Insulated Chimney Product List 2004.
Selkirk Canada Corp., Model DWS Type "L" Vent Product List 2004.

* cited by examiner

FIG. 2A
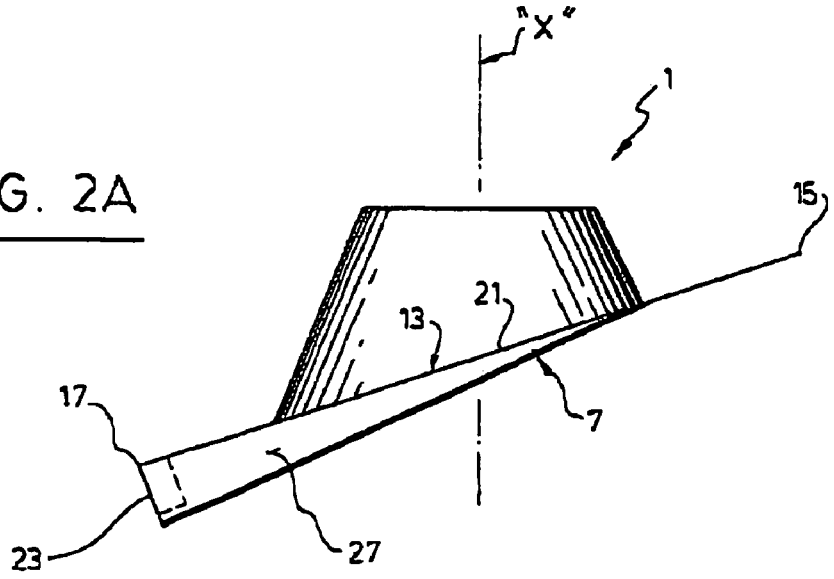
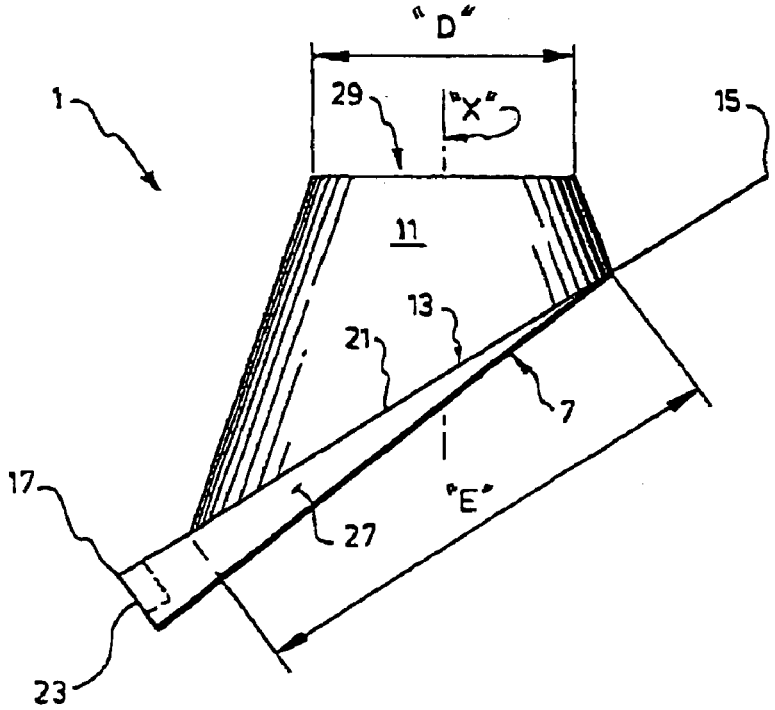
FIG. 2B

FLASHING FOR INCLINED ROOF AND METHOD FOR INSTALLING THE SAME

FIELD OF THE INVENTION

The present invention relates to a flashing useful for weatherproofing an aperture made in an inclined roof.

The invention also relates to a method for installing such a flashing onto a roof.

BACKGROUND OF THE INVENTION

It is of common practice in the construction industry to use a flashing to seal the interstitial gap between the roof and a vertical member such as a pipe, a venting duct or a chimney passing through an aperture made in this roof.

In addition to ensuring weatherproofing of the roof aperture, the flashing is usually also devised to ensure proper drainage of the water that can accumulate on the roof.

Currently, a variety of roof flashings of different shape are available for weatherproofing an aperture made in a roof to allow passage of a vertical structure. FIGS. 1A to C show three examples of such flashings respectively called "flat flashing", "gable flashing" and "pitched flashing".

The flat flashing shown in FIG. 1A is commonly used for waterproofing an opening in a flat roof or building surface.

The gable flashing shown in FIG. 1B is used for weatherproofing an opening in the peak of an inclined roof.

Last of all, the pitched flashing shown in FIG. 1C is used for weatherproofing an opening on a an inclined roof, such as a pitched, lean-to, pavilion or gable roof. In the latter case, the surrounding member of the gable flashing which is usually of the conical shape must extend from the flat base of the flashing in such an inclined direction as to accommodate the roof slope.

In use, the flat base of the pitched flashing is positioned over the aperture made in the inclined roof and fastened on the same.

As is known, the roofs can be made of variety of materials, like for example tiles, stainless steel or other metal alloys, PVC or other polymeric materials, bitumen or fiberglass. Some of these roof materials can also be in the form of corrugated sheets. In the latter case, condensation and moisture can accumulate in their grooves. When used to insulate a roof covered with a corrugated material, pitched flashings of conventional structure, viz. with a flat base, may obstruct these grooves and thus not allow efficient drainage of water that may accumulate. Furthermore, the installation of such flashings can be problematic depending on the shape of the ridges on the roof material.

SUMMARY OF THE INVENTION

A first object of the present invention is to provide a roof flashing for use on an inclined roof, which is different from the known pitched flashings and overcome some of their disadvantages, in particular when used on inclined roofs of corrugated surfaces.

More specifically, the first object of the present invention is to provide a flashing for weatherproofing an aperture made in an inclined roof, to allow the passage of substantially vertical member through this inclined roof.

Like the existing pitched flashings, the flashing according to the invention comprises a base member adapted to be mounted over the aperture made in the inclined roof, and a surrounding member extending upwardly from the base member to fit around the vertical member passing through the roof.

The base member comprises a covering panel of quadrilateral shape. This covering panel has a top edge which is adapted to be positioned on an upper part of the inclined roof and a bottom edge which is adapted to be positioned on a lower part of this roof. The covering panel also comprises two opposite side edges and an opening, this opening being large enough to allow the passage of a vertical structure passing through the roof.

In accordance with a very specific feature of the invention, the base member also comprises a bottom sidewall projecting downwardly from the bottom edge of the covering panel, and two lateral sidewalls that respectively extend downwardly from the opposite side edges of the covering panel and sidewardly from the back wall in a tapering fashion. As may be appreciated, the covering panel, bottom sidewall and lateral sidewalls of the base member altogether define a hollow housing.

The tubular surrounding member is attached to, and extends upwardly from the base member. This surrounding member comprises a top opening which is sized to tightly fit around a vertical structure passing through the inclined roof. It also comprises a bottom opening coaxially positioned on top the opening of the covering panel of the base member, and sized to allow passage therethrough of a vertical structure.

In accordance with a particularly preferred embodiment of the invention, the surrounding member of the flashing is funnel-shaped and has its top opening smaller in size than its bottom opening. Preferably, this surrounding member has a central axis inclined toward the top edge of the covering panel of the base member. Preferably also, the top opening of the surrounding member is substantially circular in shape and its bottom opening is substantially elliptic in shape.

In another particularly preferred embodiment of the invention, the lateral sidewalls of the base member are shorter in length than the covering panel of the base member. Preferably also, the flashing according to the invention is made of welded metal.

In accordance with a further preferred embodiment of the invention, the base member also comprises flanges projecting outwardly from each lateral sidewall to facilitate fastening of the flashing to the roof.

Another object of the invention is to provide a method for installing the flashing according to the invention as disclosed hereinabove. This method comprises four basic steps.

The first step consists in cutting a slot in the upper part of the inclined roof above the aperture made therein. This slot needs to be large enough to receive the top edge of the covering panel of the base member.

The second step consists in inserting the top edge of the covering panel into the slot.

The third step consists in positioning the bottom sidewall of the base member onto the lower part of the inclined roof in such a manner that the bottom opening of the surrounding member is located on top of the roof aperture.

The fourth step consists in fastening the base member to the inclined roof with suitable fastening means such as screws and nails.

In use, the aperture made in the roof can be of a shape different from the one of opening made in the flashing. The roof aperture can, for example, be rectangular.

The method according to the invention may also comprise additional optional steps. By way of example, it may comprise the additional step of applying a sealant to the junction of the roofing material and the base member of the flashing.

The method may also comprise the additional step of installing a storm collar around the top opening of the surrounding member and the vertical structure for further sealing any space left in-between them.

The method according to the invention may further comprise the additional step of inserting the top edge of the covering panel of the base member into the roof slot to such a depth that the top edges of the lateral sidewalls of the base member rest adjacent to this roof slot.

In accordance with a particularly preferred embodiment of the method, the fastening means are used to fasten to the roof the flanges projecting outwardly from each lateral sidewall of the base member.

Thanks to its particular structure and the way it is installed, the flashing according to the invention may be installed in a very easy and efficient manner on any kind of roofs, including roofs with a corrugated structure defining downwardly oriented ridges.

In such a case, one has only to cut for indentations to be into the bottom sidewall of the base member. These indentations must be large enough to receive the ridges of the corrugated roof. However, they can easily be "adjusted" to fit any kind of corrugated roofing material whatever be the form of their ridges (square, round, sinusoidal, etc.).

The same flashing can also be installed in an easy and efficient way on an inclined metal roof.

In all cases, the problem of water drainage mentioned hereinabove is solved. Thus, the flashing according to the invention is very efficient and versatile and can be used in an efficient way on any kind of roof.

The invention and its advantages will be better understood upon reading the following non-restrictive description of a preferred embodiment of it, made with reference to the accompanying drawings.

BRIEF DESCRIPTION OF THE DRAWINGS

FIGS. 2A and 2B are side elevational views of two flashing according to the invention, which are respectively adapted for use with roofs of different angulation;

DESCRIPTION OF A PREFERRED EMBODIMENT OF THE INVENTION

As aforesaid, the flashing 1 according to the invention is intended to be used for weatherproofing the gaps that exist in-between an inclined roof 3 and a vertical member passing therethrough, such as a chimney 5 as shown in the illustrated embodiment (see FIG. 6) or alternatively a pipe, a venting duct or any other kind of member having to pass through the roof.

Figure 5A:
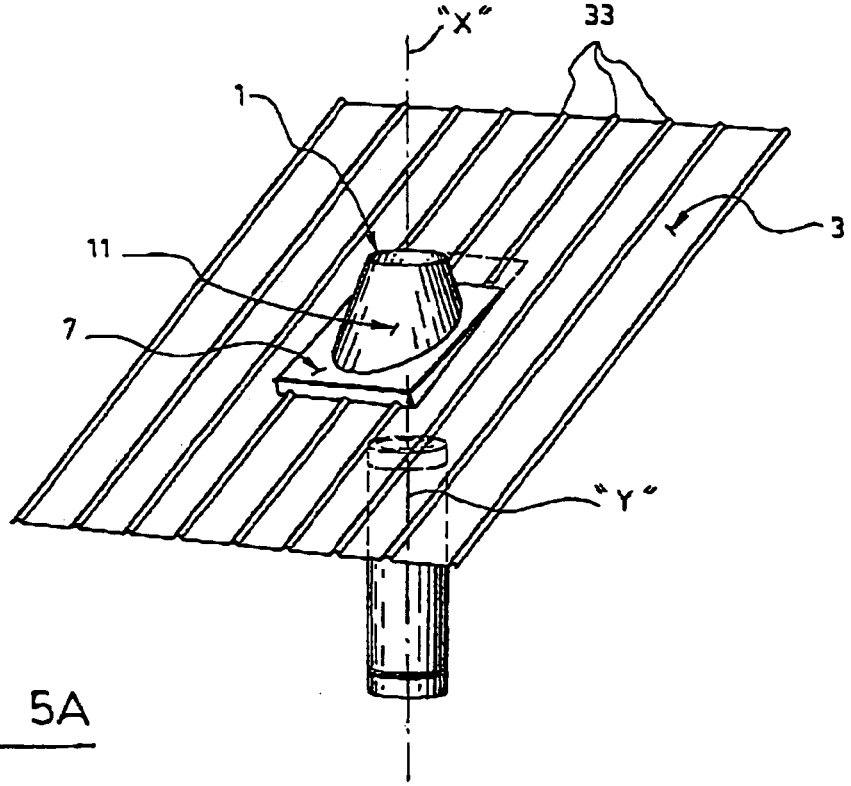
FIGS. 5A to 5C are perspective views showing successive steps of the installation of a flashing according to the invention onto a corrugated roof.
Figure 5B:
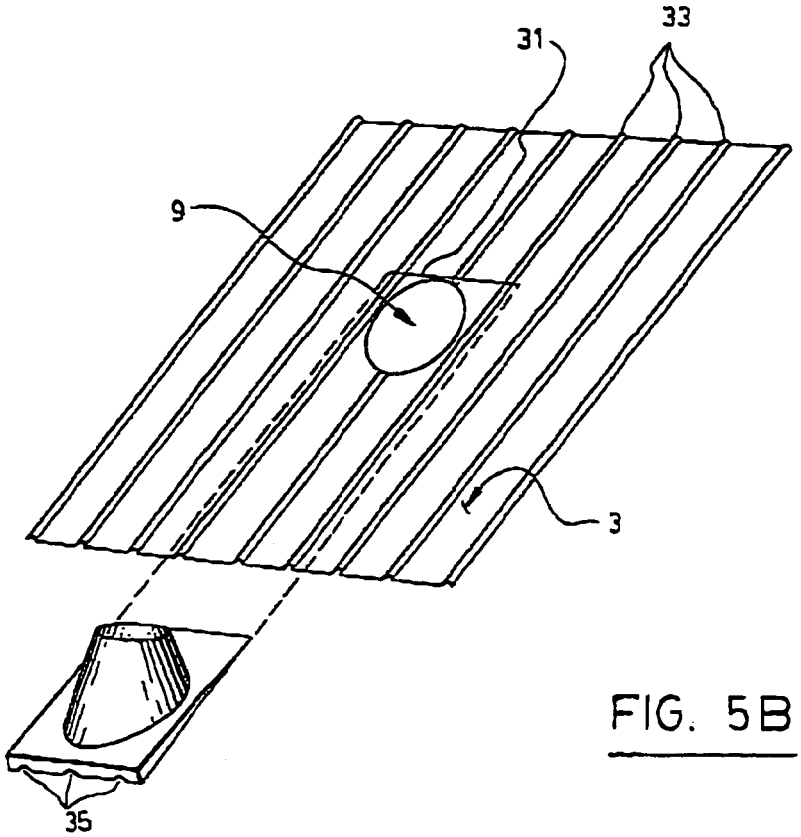

The flashing 1 comprises a base member 7 adapted to be mounted over the aperture 9 made in the inclined roof 3 to allow passage of the chimney 5 (see FIG. 5B). The flashing 1 also comprises a surrounding member 11 extending upwardly from the base member 7 to fit around the chimney 5.

As better shown in FIGS. 2A, 2B, 3 and 4, the base member 7 is in the form of a hollow housing.

It comprises a covering panel 13 of quadrilateral shape having a top edge 15 adapted to be positioned on an upper part of the inclined roof, a bottom edge 17 adapted to be positioned on a lower part of the inclined roof and two opposite side edges 19, 21. The covering panel 13 is provided with an opening 23 large enough to allow passage of the chimney 5 therethrough.

The base member also comprises a bottom sidewall 23 projecting downwardly from the bottom edge 17 of the covering panel and two lateral sidewalls 25, 27 that respectively extend downwardly from the opposite side edges 19, 21 of the covering panel and sidewardly from the bottom sidewall 23 in a tapering fashion. As aforesaid, the covering panel 13, the bottom sidewall 23 and lateral sidewalls 25, 27 altogether define a hollow housing.

Figure 1A:
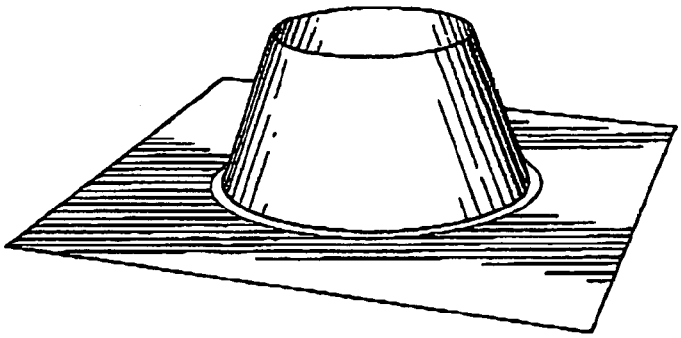
FIG. 1A ( prior art )
FIGS. 1A to 1C identified as "prior art" are perspective views of three different kinds of flashing already in use.
Figure 1B:
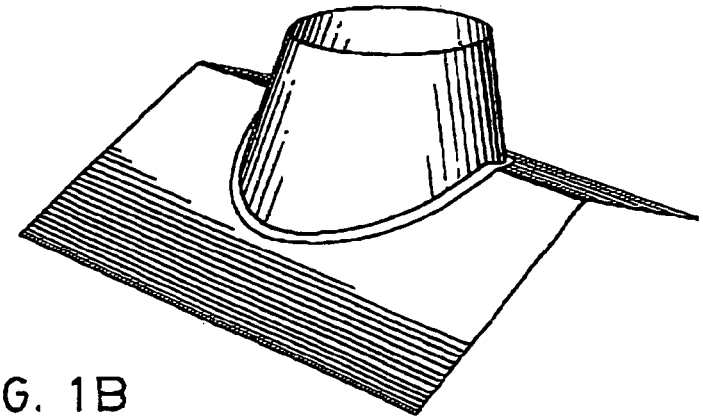
FIG. 1B ( prior art )
Figure 1C:
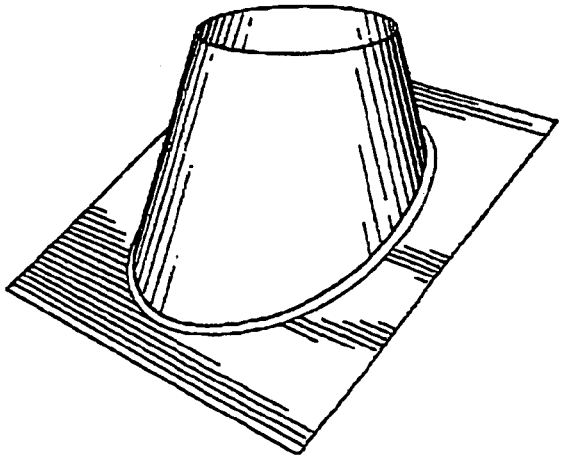
FIG. 1C ( prior art )
Figure 3:
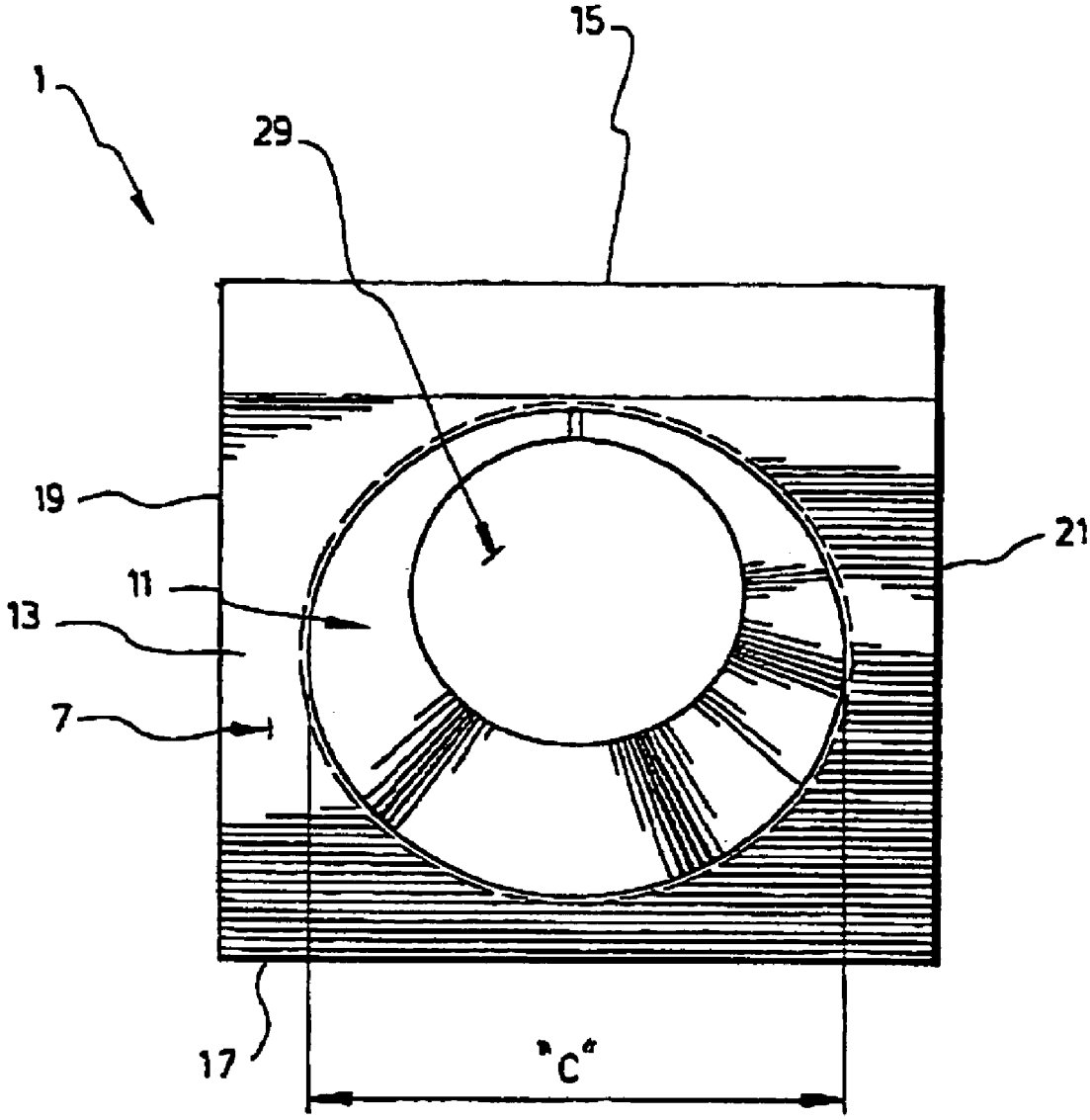
FIG. 3 is a top plan view of the flashing according to the invention as shown in FIG. 2A.
Figure 4:
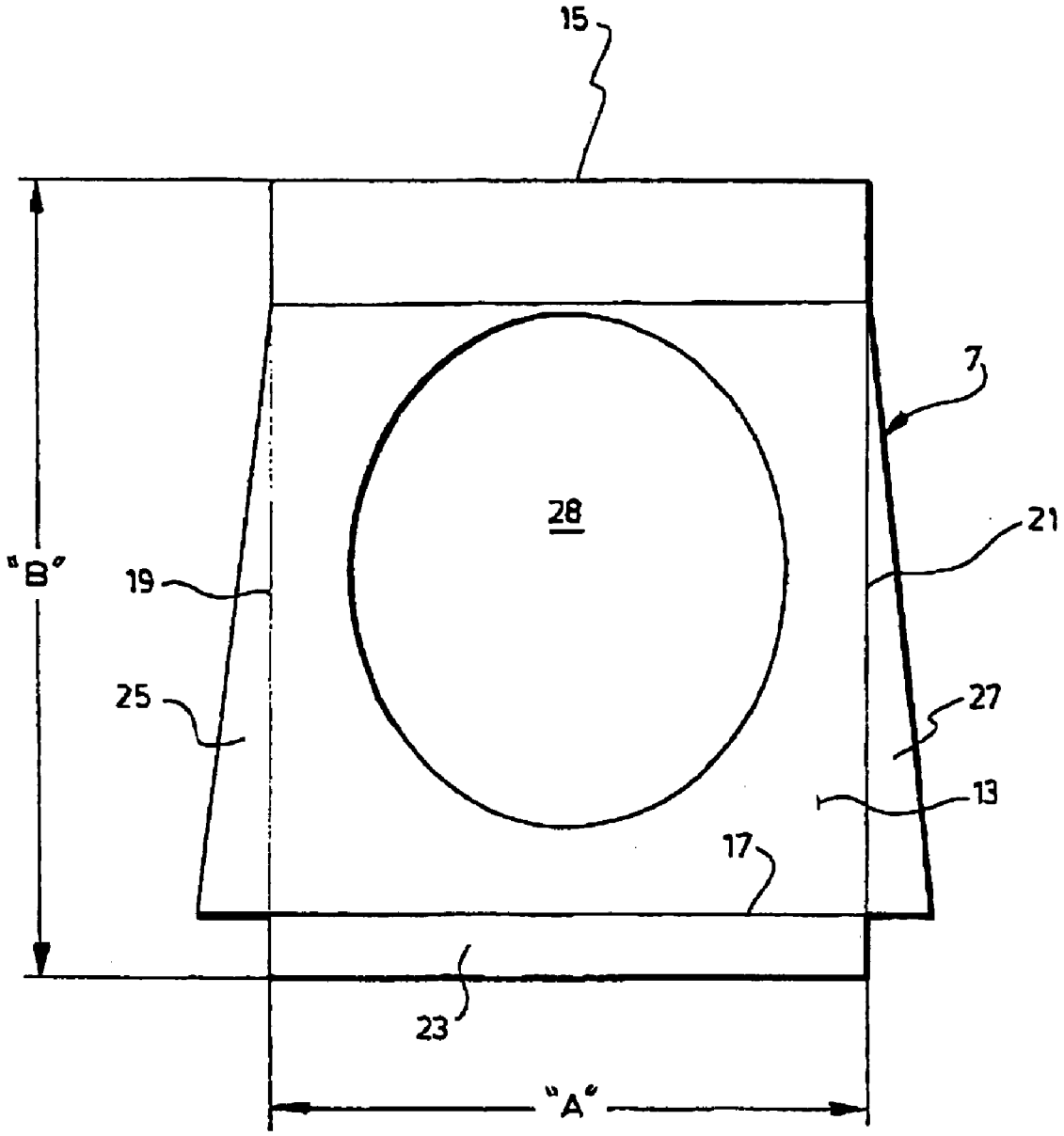
FIG. 4 is a top plan view of the sheet of metal used to make the base member of the flashing shown in FIGS. 2A and 3, before this sheet is processed and folded to form a hollow housing.

As is shown in FIG. 4, the base member 7 can be made from a metal sheet cut in such a way that, after properly folding its lateral and bottom parts, the requested bottom and lateral sidewalls 23, 25 and 27 of the base member 7 are "created" and properly positioned to allow welding of their adjacent edges to achieve the requested hollow housing form.

Preferably, as shown in FIGS. 2A and 2B, the lateral sidewalls 25, 27 of the base member 7 are shorter in length than the covering panel 13. Such allows formation of a flat flange adjacent to the top edge 15 and thus facilitates insertion and positioning of the top edge of the base member 7 in the slot cut in the roof during installation of the flashing, as will be better explained hereinafter.

Figure 7:
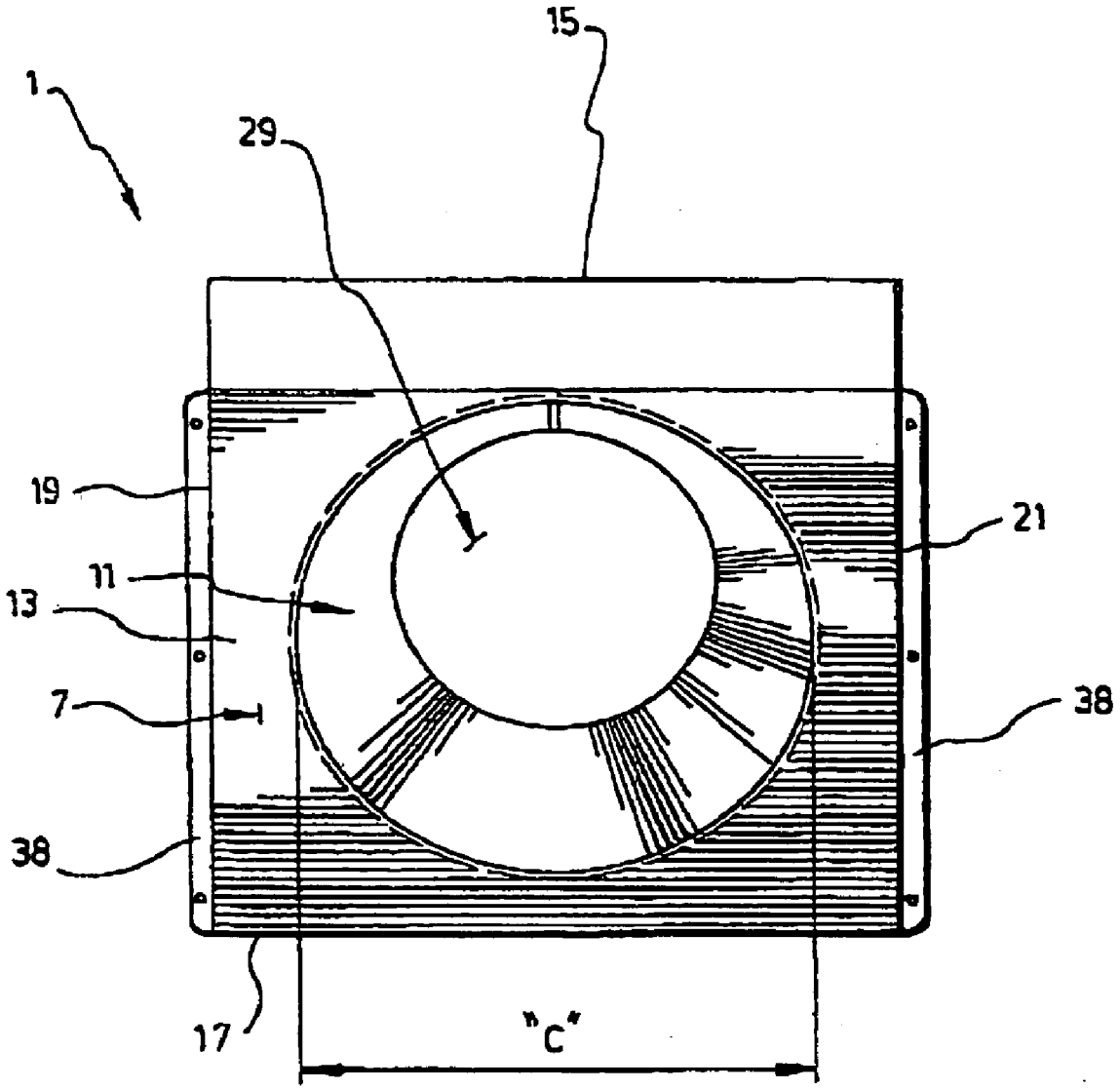
FIG. 7 is a is a top plan view of a flashing according to the invention with flanges projecting outwardly from each lateral sidewall.
Figure 8:
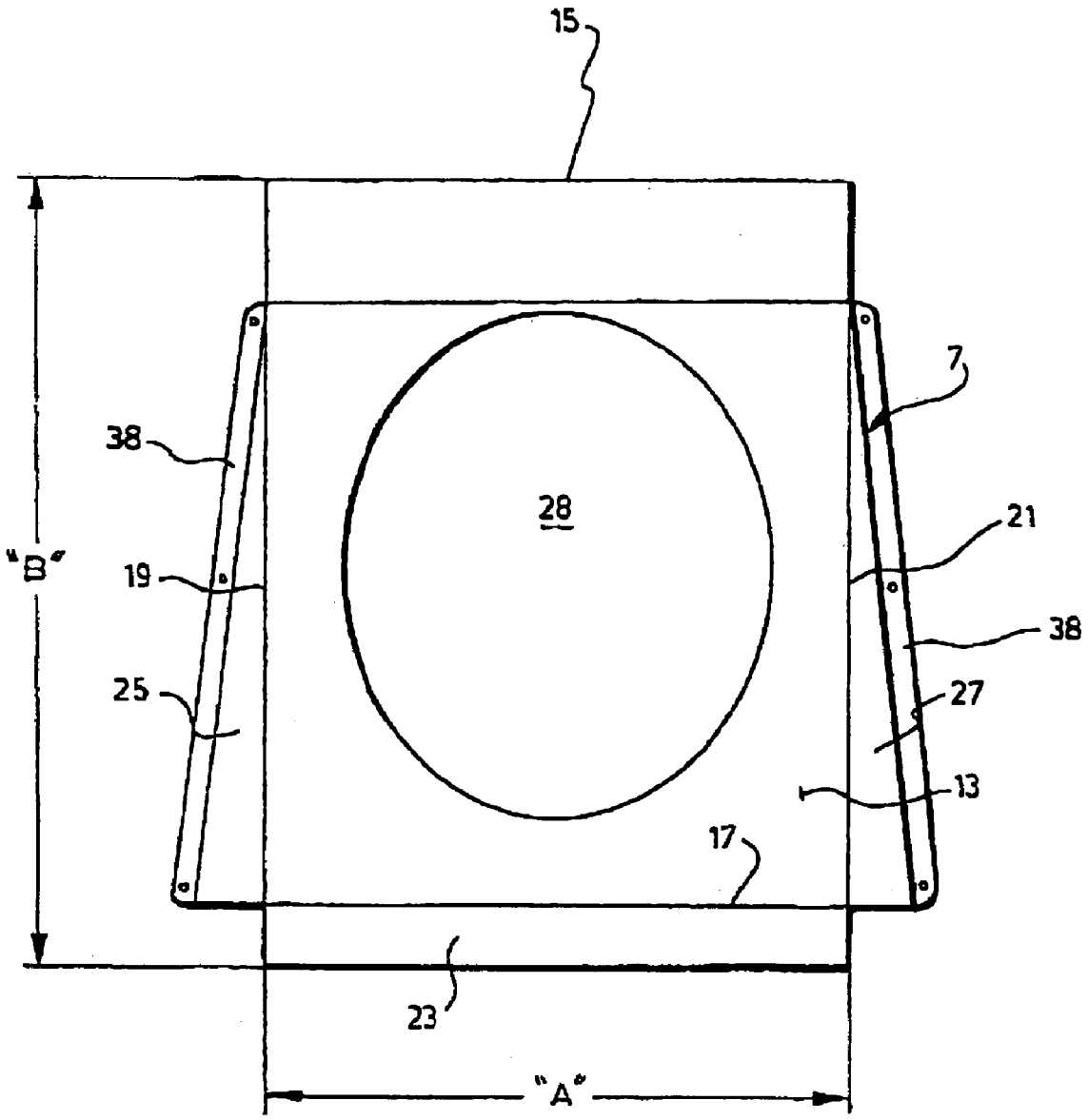
FIG. 8 is a is a top plan view of the sheet of metal used to make the base member of the flashing shown in FIG. 7, before this sheet is processed and folded to form a hollow housing.

Also preferably, as shown in FIG. 7, the base member 7 comprises flanges 38 flanking both lateral sidewalls 25,27 to help in securing the base member 7 to the roof.

As also shown in the drawings, the surrounding member 11 is tubular in shape, preferably made of metal too, and attached to the base member 7 by welding. The surrounding member 11 comprises a top opening 29 sized to tightly fit around the chimney 5; and a bottom opening coaxially positioned on top the opening 23 of the covering panel 13 of the base member. Of course, the bottom opening must also be sized to allow passage therethrough of the chimney 5.

As shown, the surrounding member 11 is preferably shaped as a funnel. Thus, its top opening 29 is smaller in size than its bottom opening.

Inasmuch as, in most constructions, the chimney 5, pipe or other member that have to pass through the roof, extend vertically and the roof on which the flashing 1 is intended to be installed for weatherproofing purpose is itself inclined, the surrounding member 11 has to be oriented at an angle selected as a function of the inclination of the roof. In other words, the central axis "X" of this surrounding member 11 will be inclined toward the top edge 15 of the covering panel 13 of the base member 7.

In such a case also, the top opening 29 of the surrounding member 11 will be substantially circular in shape and the bottom opening of the surrounding member will substantially elliptic in shape and sized to match the size of the opening 23 made in the covering panel 13 of the base member 7.

FIGS. 2A and 2B are illustrative of the shape and inclination that may have the surrounding member 11 as a function of the actual slope or inclination of the roof. FIG. 2A shows the shape that the flashing 1 must have to fit on a roof having a pitch of 1/12 to 7/12. FIG. 2B shows the same shape for a flashing adapted to fit on a roof with a pitch of 8/12 to 12/12 (2B). The expression "roof pitch" as used hereinabove refers here to a measurement used to quantify the steepness a roof. It is measured by the rise in inches for each 12 inches of horizontal run. The larger the fraction, the steeper the roof is. Of course, other shapes could be selected depending on the user's needs.

The following Tables 1 and 2 summarize the dimensions that may have the flashing 1 according to the invention as shown in the accompanying drawings.

As can be appreciated, these dimensions vary as a function of the diameter of the chimney. Value (A) is a measurement of the length of both the top and bottom edges 15, 17 of the base member 7. Value (B) represents the length of the covering wall 13 of the base member. Value (C) denotes the width of the bottom opening of the surrounding member 11 and value (D) the diameter of the top opening 29 of the same member 11. Value (E) represents the length of the bottom opening of the surrounding member 11.

TABLE 1

Dimensions (in inches) of a flashing for a roof with a pitch of 1/12 to 7/12 (see FIG. 2A)

| Diameter of the chimney (inches) | 5 | 6 | 7 | 8 |
|---|---|---|---|---|
| A | 24 | 24 | 24 | 24 |
| B | 24 | 24 | 24 | 26 |
| C | 12⅛ | 13⅛ | 13½ | 14½ |
| D | 7⅜ | 8⅜ | 9⅜ | 10⅜ |
| E | 12⅝ | 13⅞ | 14¼ | 15⅜ |

TABLE 2

Dimensions (in inches) of a flashing for a roof with a pitch of 8/12 to 12/12 (see FIG. 2B)

| Diameter of the chimney (inches) | 5 | 8 | 7 | 8 |
|---|---|---|---|---|
| A | 24 | 24 | 26 | 26 |
| B | 28 | 26 | 28 | 30 |
| C | 14⅜ | 13¾ | 15⅛ | 16¼ |
| D | 7⅜ | 8⅜ | 9⅜ | 10⅜ |
| E | 17⅛ | 16½ | 18¼ | 19⅞ |

TABLE 3

Dimensions (in inches) of a second embodiment of a flashing for a roof with a pitch of 1/12 to 7/12

| Diameter of the chimney (inches) | 5 | 6 | 7 | 8 |
|---|---|---|---|---|
| A | 24¾ | 24¾ | 24¾ | 24¾ |
| B | 21¾ | 21¾ | 21¾ | 23¾ |
| C | 29⅛ | 29⅛ | 29⅛ | 29⅛ |
| D | 24 | 24 | 24 | 26 |
| E | 7⅜ | 8⅜ | 9⅜ | 10⅜ |

TABLE 4

Dimensions (in inches) of a second embodiment of a flashing for a roof with a pitch of 8/12 to 12/12

| Diameter of the chimney (inches) | 5 | 8 | 7 | 8 |
|---|---|---|---|---|
| A | 24¾ | 24¾ | 26¾ | 26¾ |
| B | 25¾ | 23¾ | 25¾ | 27¾ |
| C | 25⅝ | 29⅛ | 31⅝ | 32 1/16 |
| D | 28 | 26 | 28 | 30 |
| E | 7⅜ | 8⅜ | 9⅜ | 10⅜ |

TABLE 5

Dimensions (in inches) of a flashing for a roof with a pitch of 12/12 to 21/12

| Diameter of the chimney (inches) | 5 | 8 | 7 | 8 |
|---|---|---|---|---|
| A | 26¾ | 26¾ | 26¾ | 26¾ |
| B | 31¾ | 37¾ | 38¾ | 40¾ |
| C | 31 3/16 | 31 3/16 | 31 3/16 | 31 3/16 |
| D | 31¾ | 37¾ | 38¾ | 40¾ |
| E | 7⅜ | 8⅜ | 9⅜ | 10⅜ |

As disclosed hereinabove in the Summary of the Invention, the flashing 1 according to the invention can be installed in a very simple yet efficient way with a method involving four basic steps to which may be added a plurality of optional steps.

Figure 5C:
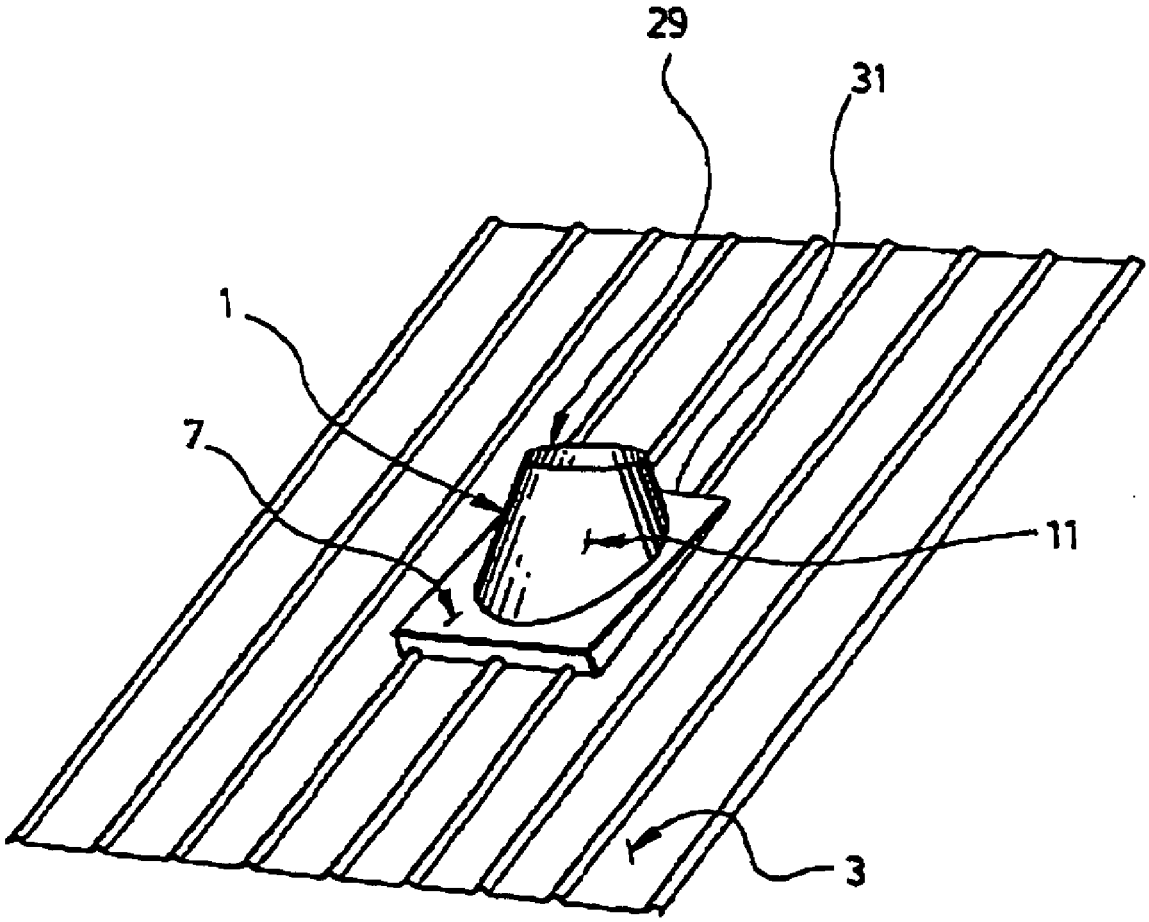
Figure 6:
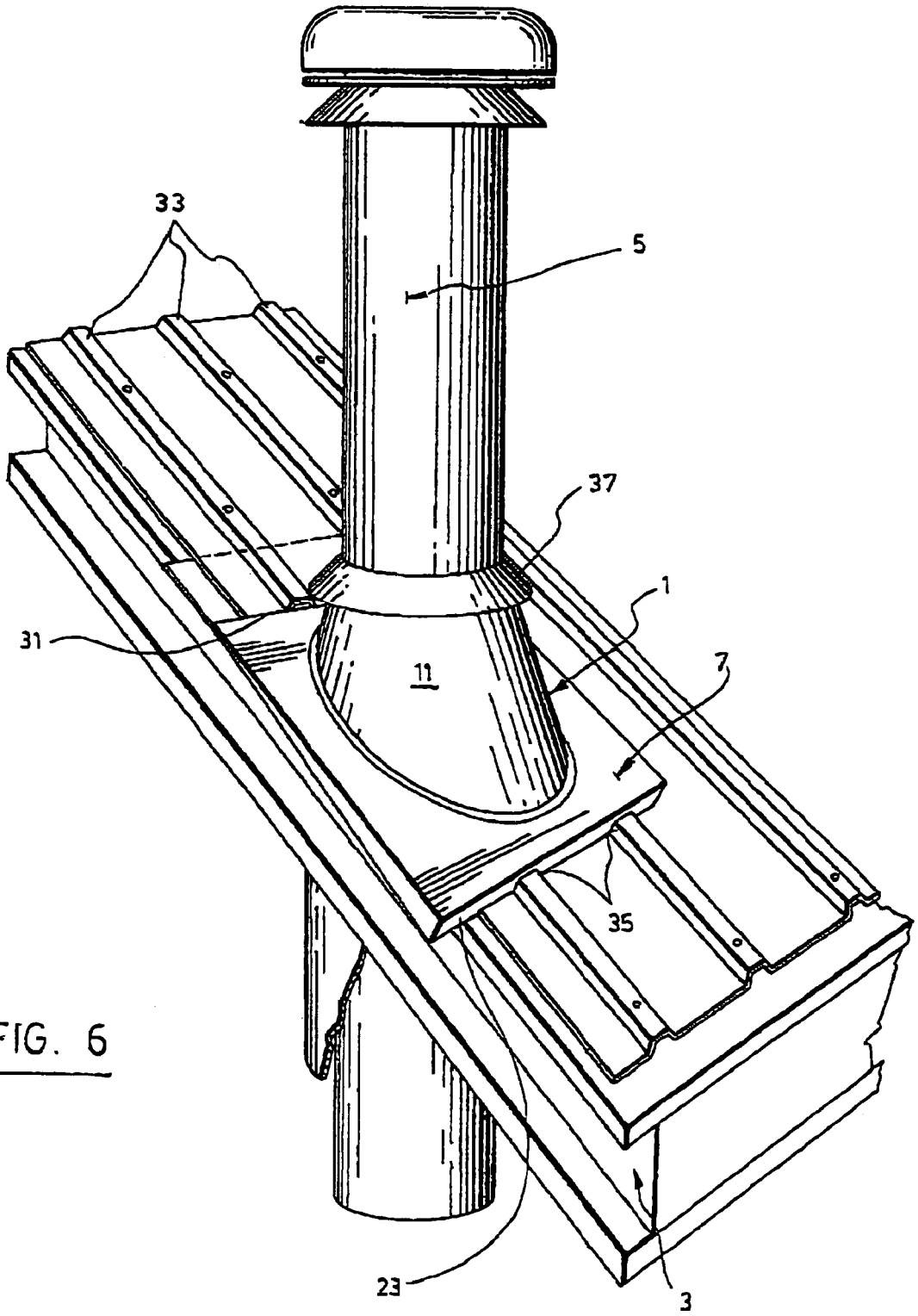
FIG. 6 is a perspective view of the flashing shown in FIGS. 2B, 3 and 4 after it has been installed onto a roof and the installation of the chimney has been completed.

As shown in FIGS. 5A to 5C, the installation of the flashing 1 onto a roof through which passes a chimney 5 as illustrated in FIG. 6, may be carried out using the following sequence of steps:

1. aligning the axis "X" (or centerline) of the flashing 1 with the centerline "Y" of the chimney, as shown in FIG. 5A.
2. drawing the interior outline of the surrounding member 11 of the flashing on the roof, as shown in FIG. 5B.
3. removing the flashing 1 and cutting an aperture 9 in the roofing material by following the previously drawn interior outline.
4. cutting a slot 31 parallel to the peak of the roof and centered along an axis passing through the middle of the aperture 9, so as to receive the top edge 15 of the covering panel 13 of the basic member 7;
5. inserting the top edge 15 of the base member 7 of the flashing into the slot 31 and resting the bottom sidewall 23 of the base member 7 of the flashing towards the bottom part of the roof, such an insertion into the slot 31 being preferably made to such a depth that the top edges of said lateral sidewalls 27 of the base member rest adjacent to the roof slot 31;

6. outlining the profile of the roof ridges 33 in the case the roofing material is corrugated as shown in the drawings and has such ridges, on the bottom sidewall of the flashing and cutting indentations 35 that correspond to the shape of the roof ridges and are large enough to fit these roof ridges, as shown in FIG. 6;
7. fastening the flashing to the roof using, for example, at least six wood screws sealed with metal/rubber washers or silicone or alternatively nails or other fixation means;
8. sealing the base member 7 of the flashing 1 at the roof junction with an external grade sealant;
9. inserting the chimney 5 through the flashing; and
10. installing a storm collar 37 around the junction of the flashing 1 and the chimney 5 and optionally sealing the storm collar 37 to the chimney 5 with a caulking roll (ECR™) or silicone.

Figure 9A:
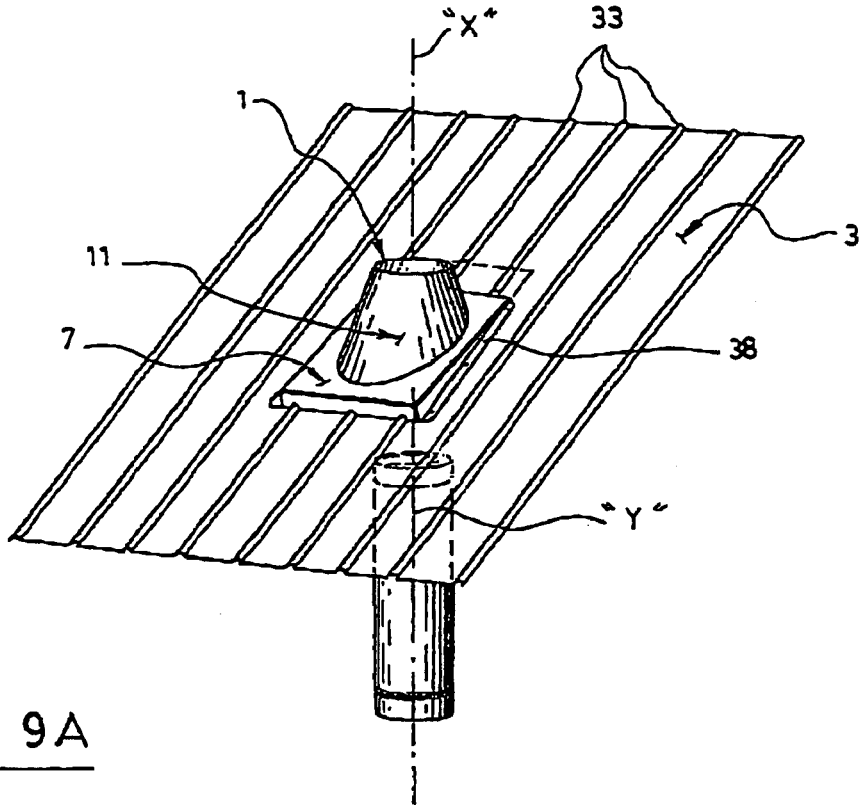
FIG. 9A to 9C are perspective views showing successive steps of the installation of the flashing shown in FIG. 7 onto a corrugated roof.
Figure 9B:
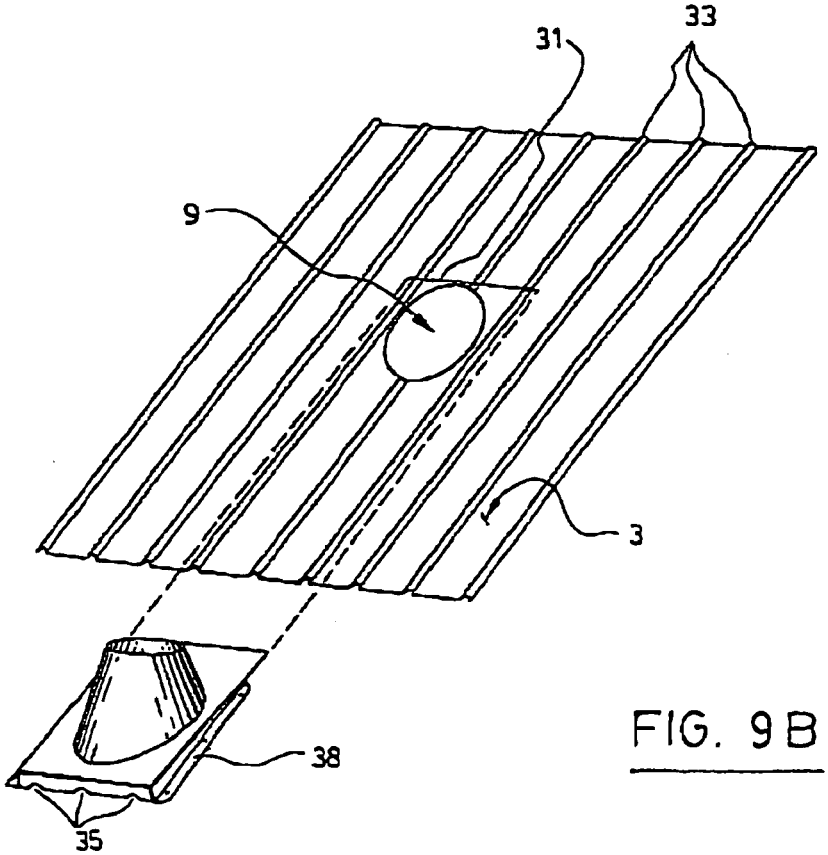
Figure 9C:
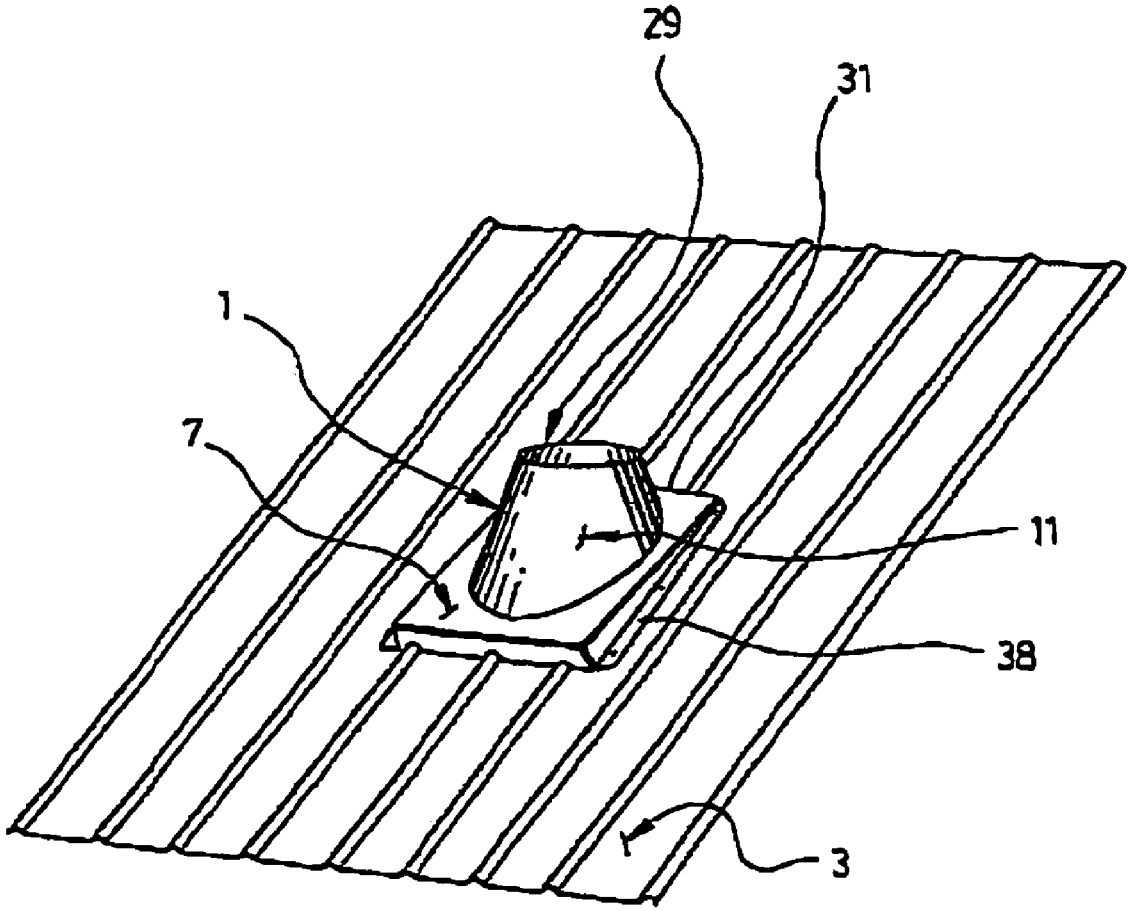

In a preferred embodiment of step 7, as illustrated in FIG. 9C, the fastening of the flashing to the roof may be carried out by fixing the flanges 38 to the roof with the aforesaid fixation means.

As aforesaid, a main advantage of the flashing according to the invention is that it can be efficiently installed onto a corrugated roof. In such a case and as already disclosed hereinabove (see step 6), indentations 35 can be cut into the bottom sidewall 15 of the flashing 1 so as to fit the ridges of the roofing material.

Such makes it possible to install the flashing 1 onto any kind of inclined corrugated roof, especially made of metal while providing an efficient insulation from the outside and more particularly from moisture.

Another advantage of the invention is that the flashing 1 provides an easy and simple way to seal any gaps formed in-between an inclined roof and a vertical structure passing through this roof. This flashing is particularly useful when used on inclined corrugated metal roofs.

Of course, it may be understood that the present invention has been described in detail hereinafter and illustrated in the accompanying drawings. As a matter of fact, numerous obvious modifications could be made to it without departing from the scope or spirit of the present invention.

The invention claimed is:

1. A flashing for weatherproofing an aperture made in an inclined roof to allow passage of a substantially vertical member through said inclined roof, said flashing comprising:

a) a base member adapted to be mounted over the aperture made in the inclined roof, said base member comprising:

a covering panel of quadrilateral shape having a top edge adapted to be positioned on an upper part of the inclined roof, a bottom edge adapted to be positioned on a lower part of the inclined roof, two opposite side edges and an opening, said opening being large enough to allow passage of said substantially vertical member therethrough;

a bottom sidewall projecting downwardly from the bottom edge of the covering panel;

two lateral sidewalls that respectively extend downwardly from the opposite side edges of said covering panel and sidewardly from said bottom sidewall in a tapering fashion;

said covering panel, bottom sidewall and lateral sidewalls together defining a hollow housing; and b) a surrounding member extending upwardly from said base member to fit around said substantially vertical member, said surrounding member being tubular in shape and attached to said base member and comprising;

a top opening sized to tightly fit around said substantially vertical member; and a bottom opening coaxially positioned on top the opening of the covering panel of the base member, said bottom opening being sized to allow passage therethrough of said substantially vertical member.

2. The flashing according to claim 1 wherein the surrounding member is funnel-shaped and its top opening is smaller in size than its bottom opening.

3. The flashing according to claim 2 wherein the surrounding member has a central axis, and said central axis is inclined toward the top edge of the covering panel of the base member.

4. The flashing according to claim 3 wherein the top opening of the surrounding member is substantially circular in shape and the bottom opening of the surrounding member is substantially elliptic in shape.

5. The flashing according to claim 1, wherein the lateral sidewalls of the base member are shorter in length than the covering panel of the base member.

6. The flashing according to claim 1, wherein the base member further comprises flanges projecting outwardly from the lateral sidewalls.

7. The flashing according to claim 1, which is made of welded metal.

8. A method for installing a flashing as claimed in claim 1, comprising:

cutting a slot in the upper part of the inclined roof above the aperture made therein, said slot being large enough to receive the top edge of the covering panel of the base member;

inserting the top edge of the covering panel into the slot cut in the inclined roof;

positioning the bottom sidewall of the base member onto the lower part of the inclined roof in such a manner that said bottom opening of the surrounding member is located on top of said roof aperture; and fastening the base member to the inclined roof with fastening means.

9. The method as claimed in claim 8, wherein the fastening means are selected from the group consisting of screws and nails.

10. The method as claimed in claim 8, further comprising applying a sealant at the junction of the roofing material and the base member of the flashing.

11. The method as claimed in claim 8, further comprising installing a storm collar around the top opening of the surrounding member and the substantially vertical member.

12. The method as claimed in claim 8, wherein the inclined roof is corrugated and defines downwardly oriented ridges.

13. The method as claimed in claim 12, further comprising cutting indentations into the bottom sidewall of the base member, said indentations being large enough to receive the ridges of said corrugated roof.

14. The method as claimed in claim 8, wherein said inclined roof is a metal roof.

15. The method as claimed in claim 8, wherein said substantially vertical member is a chimney.

16. The method as claimed in claim 8, further comprising inserting the top edge of the covering panel of the base member into the roof slot to such a depth that the top edges of said lateral sidewalls of the base member rest adjacent to said roof slot.

* * * * *